US005469799A

United States Patent [19]

Iwai et al.

[11] Patent Number: 5,469,799

[45] Date of Patent: Nov. 28, 1995

[54] LIQUID CARGO TRANSPORT SHIP HAVING DOUBLE-HULL STRUCTURE

[75] Inventors: Kiyoshi Iwai, Kashihara; Kimio Kondo, Nara; Yoshiaki Sezaki, Osaka; Masatoshi Fukata, Otsu; Eiji Hashimoto, Ibaraki; Toshio Yoshioka, Kawachinagano, all of Japan

[73] Assignee: Hitachi Zosen Corporation, Osaka, Japan

[21] Appl. No.: 428,356

[22] Filed: Apr. 21, 1995

Related U.S. Application Data

[63] Continuation of Ser. No. 216,713, Mar. 23, 1994, abandoned.

[30] Foreign Application Priority Data

Apr. 6, 1993 [JP] Japan ..... 5-078425

[51] Int. Cl.[6] ..... B63B 1/00

[52] U.S. Cl. ..... 114/74 A

[58] Field of Search ..... 114/74 R, 74 T, 114/74 A

[56] References Cited

U.S. PATENT DOCUMENTS

| | | | |
|---|---|---|---|
| 2,896,416 | 7/1959 | Henry | 114/74 A |
| 3,326,167 | 6/1967 | Paoli | 114/74 A |
| 3,797,437 | 3/1974 | Cowles | 114/74 A |
| 3,926,135 | 12/1975 | De Gregorio | 114/74 R |
| 4,409,919 | 10/1983 | Strain | 114/74 R |

FOREIGN PATENT DOCUMENTS

| | | | |
|---|---|---|---|
| 718668 | 9/1965 | Canada | 114/74 R |
| 2017028 | 9/1979 | United Kingdom . | |
| 2047187 | 11/1980 | United Kingdom . | |

OTHER PUBLICATIONS

Patent Abstracts of Japan, vol. 4, No. 176 (M–45) (658) 5 Dec. 1980 and JP–A–556 123 588 (Yamashita Shin Nippon Kisen KK) 24 Sep. 1980.

*Primary Examiner*—Jesus D. Sotelo

*Attorney, Agent, or Firm*—D. Peter Hochberg; Mark Kusner; Michael Jaffe

[57] ABSTRACT

The liquid cargo transport ship according to the invention is complete with a double-hull structure comprising a side plating 2 and an internal plating 3 for constituting the bottom and side construction respectively surrounding cargo tanks 4 available for loading liquid cargo. Space domain 5 formed between the side plating 2 and the internal plating 3 is utilized for constituting a plurality of ballast tanks.

A plurality of tanks 12R and 12L solely being available for ballasting purpose are provided in part of the interior of cargo tanks 4R and 4L which are disposed in the central domain of the ship 1 in the fore-and-aft direction.

4 Claims, 8 Drawing Sheets

LIQUID CARGO TRANSPORT SHIP HAVING DOUBLE-HULL STRUCTURE

This is a continuation of application Ser. No. 08/216,713 filed on Mar. 23, 1994 now abandoned.

FIELD OF THE INVENTION

The present invention relates to a liquid cargo transport ship such as a tanker at least comprising double-hull structure all over the bottom and side construction.

BACKGROUND OF THE INVENTION

Conventionally, structure of cargo tanks of any conventional liquid cargo tanker having known double-hull structure disposes a U-shaped internal hull plating inside of a U-shaped external side plating across a predetermined distance between them.

Internal space generated by provision of the U-shaped internal hull plating in a tanker is made available for a plurality of cargo tanks for storing liquid cargo, whereas another U-shaped space domain between the internal and external hull platings is made available for a plurality of ballast tanks.

Conventional cargo tanks formed inside of the U-shaped internal side plating of any conventional tanker are respectively sectioned into a center tank and wing tanks by a pair of longitudinal bulkheads. In addition, these cargo tanks are also sectioned into a plurality of tanks along cargo tank length fore and aft by means of a plurality of transverse bulkheads. In the same way, the above-cited conventional ballast tanks are also sectioned into a plurality of tanks along cargo tank length fore and aft by means of a plurality of transverse bulkheads.

However, according to the above-cited conventional hull structure, in regard to the U-shaped space domain available for making up the above-cited ballast tanks, in order to secure absolute volume of ballast and absolute strength of the hull structure, normally, depth (width) provided for the bottom and side construction of the hull exceeds the actually required value.

Furthermore, since any conventional tanker utilizes U-shaped space domain between the internal and external hull platings of the hull for making up ballast tanks, when the tanker is fully loaded with cargo, all the cargo tanks are filled with liquid cargo, thus causing extraordinary longitudinal bending moment to adversely affect the hull structure. This in turn necessitates shipbuilders to provide the hull structure with large-scale reinforcement. Furthermore, even when effectuating reinforcement, if the allowance against the reinforced hull strength were too short, then, degree of freedom for cargo loading will disadvantageously be constrained.

DISCLOSURE OF THE INVENTION

Therefore, the object of the invention is to provide a novel transport ship (tanker) enabling shipbuilders to set depth (width) of an internal hull plating and a side plating of the hull structure to an optimal value and capable of securely decreasing longitudinal bending moment acting upon the hull structure when fully being loaded with cargo.

To achieve the above object, the novel transport ship according to the invention is provided with double-hull structure consisting of side and internal platings surrounding cargo tanks based on utilization of space domain formed between the side and internal platings of the hull in order to make up a plurality of tanks solely available for ballasting purpose. Characteristically, a plurality of tanks solely available for ballasting purpose are provided at least in part of the interior of cargo tanks disposed in the center domain of the hull in the fore-and-aft direction.

According to the structure defined above, by enabling shipbuilders to properly adjust capacity of those tanks solely available for ballasting purpose provided in part of cargo tanks in the center domain of the hull in the fore-and-aft direction, shipbuilders can properly determine depth (width) of the bottom and side construction of the novel transport ship incorporating double-hull structure at an optional value in order to decrease capacity of ballast tanks formed between the side plating and the internal hull plating in consideration of the hull strength.

As mentioned above, by shallowing depth (width) of the bottom and side construction of the transport ship incorporating the above-referred double-hull structure, shipbuilders can precisely and efficiently carry out welding, installing, and painting operations needed for construction of the double-hull structure of the transport ship related to the invention.

In particular, since a plurality of tanks solely available for ballasting purpose without cargo load are provided in the center domain of the hull structure when the ship is fully loaded with cargo, longitudinal bending moment of the hull structure can securely be decreased. This in turn permits shipbuilders to dispense with costly reinforcement of the hull structure and gain greater degree of freedom for the cargo loading.

According to a preferred embodiment of the invention, when building the transport ship incorporating the novel double hull structure described above, those tanks solely available for ballasting purpose may be interconnected with conventional ballast tanks.

According to another preferred embodiment of the invention, when building the transport ship incorporating the novel double hull structure, those tanks solely available for ballasting purpose may be provided between the port side ballast tank and the starboard side ballast tank.

Further details of advantageous features and effects of the invention will more apparently be understood from the detailed description rendered in association with the accompanying drawings that follow.

DESCRIPTION OF THE PREFERRED EMBODIMENTS

Figure 1:
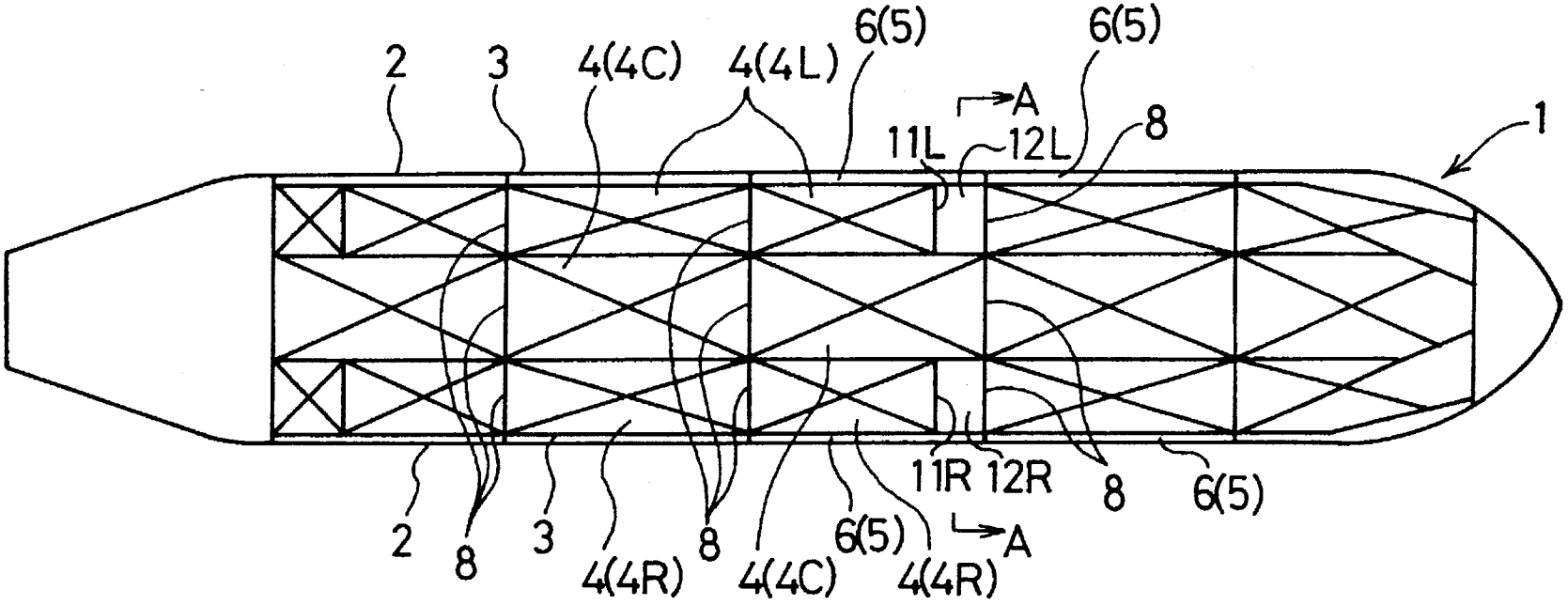
FIG. 1 is a horizontal sectional view of cargo tanks of the transport ship according to the first embodiment of the invention.
Figure 2:
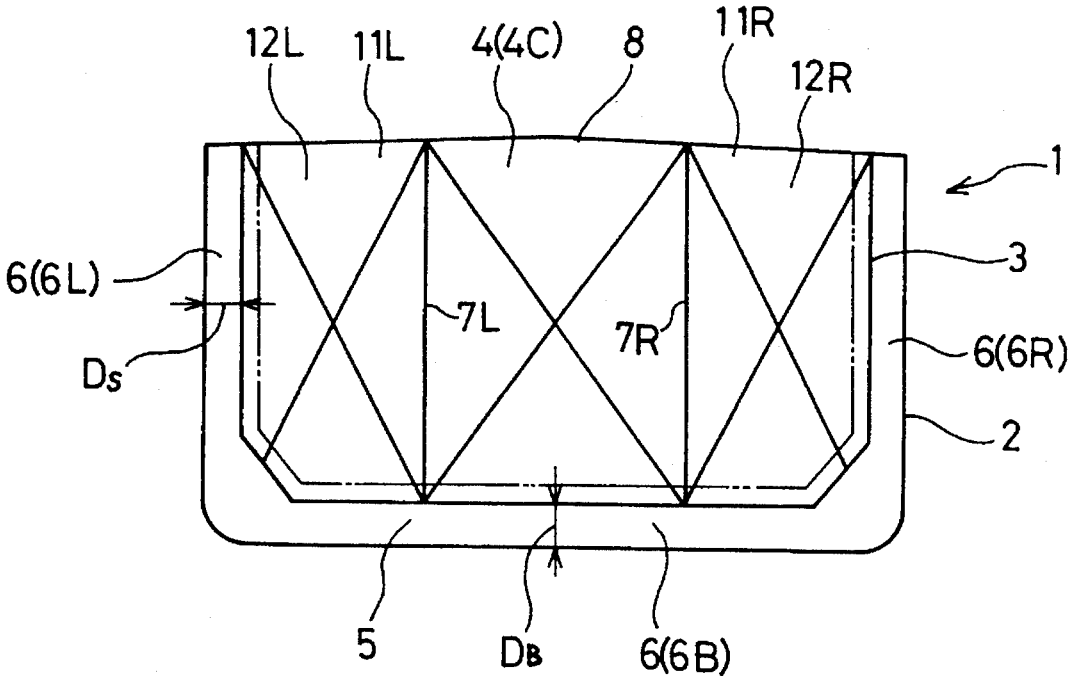
FIG. 2 is a cross-sectional view of the cargo tanks across line A—A shown in FIG. 1.

Referring now to FIGS. 1 through 4, novel hull structure of a transport ship incorporating double-hull structure according to the first embodiment of the invention is described below. The reference numeral 1 shown in FIGS. 1 through 3 designates a transport ship (tanker) incorporating double-hull structure operated for transporting liquid cargo such as crude oil for example. Referring now to the hull structure in correspondence with cargo tanks of the transport ship 1, a U-shaped internal hull plating 3 is disposed inside of a U-shaped side plating 2 via a predetermined distance. Inner space domain of the internal hull plating 3 constitutes a plurality of liquid cargo tanks 4 for loading liquid cargo such as crude oil for example. Inner space domain 5 between the U-shaped internal hull plating 3 and the side plating 2 is utilized for constituting a plurality of ballast tanks 6.

Those liquid cargo tanks 4 formed inside of the side plating 3 are respectively sectioned into a center tank **4*c* and wing tanks 4R and 4L by means of a pair of longitudinal bulkheads 7R and 7L, where the liquid cargo tanks 4 are also sectioned into a plurality of tanks along cargo tank length fore and aft by means of a plurality of transverse bulkheads 8. Likewise, those ballast tanks 6 are also sectioned into a plurality of tanks along cargo tank length fore and aft by means of the above-referred transverse bulkheads 8**.

Among those central liquid tanks 4 provided in the fore-and-aft direction of the hull structure, a plurality of transversely sectioning bulkheads 11R and 11L are respectively secured to the wing tanks 4R and 4L, where these wing tanks 4R and 4L are so arranged that partial domains of them can respectively function as tanks 12R and 12L solely being available for ballasting purpose.

In this way, by converting partial domains of those central liquid tanks 4 into the tanks 12R and 12L solely being available for ballasting purpose, shipbuilders can decrease capacity of the proper ballast tanks 6 formed in space domain 5 between the U-shaped side plating 2 and the U-shaped internal plating 3 without lowering the capacity below a total capacity corresponding to the minimum ballast volume prescribed by industrial requirements.

Figure 3:
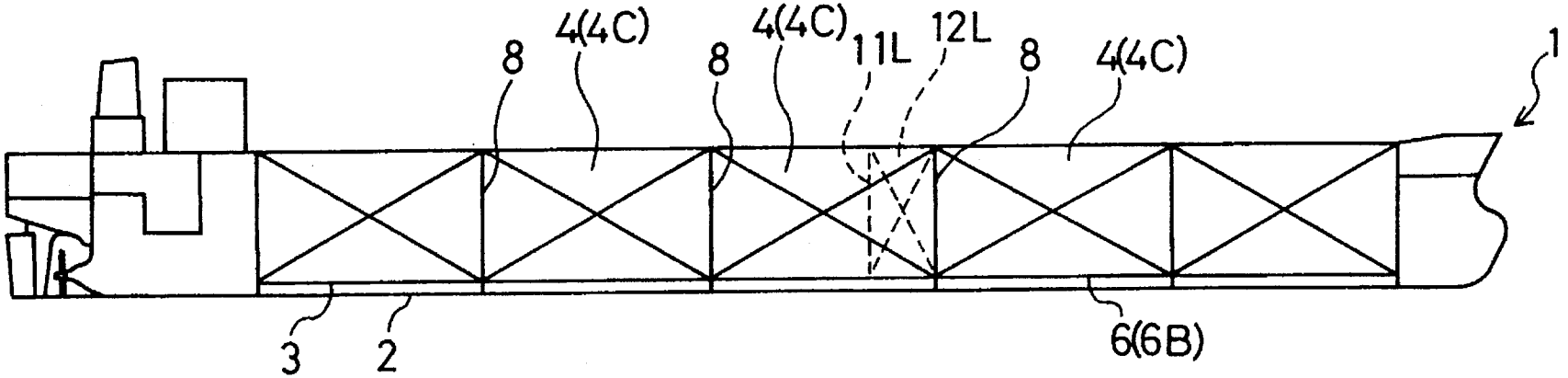
FIG. 3 is a vertical sectional view of the transport ship according to the first embodiment of the invention.

Therefore, as shown in FIG. 3, by enabling shipbuilders to properly adjust capacity of the tanks 12R and 12L solely being available for ballasting purpose, depth DB of the bottom structure and depth (width) DS of the side structure of the hull in the space domain 5 can respectively be determined to such values being shallower (narrower) than those of the conventional hull structure (designated by means of imaginary lines) and enough to secure the essential hull strength.

Therefore, by effect of shallowing (narrowing) depth (width) values DB and DS of the space domain 5 functioning as the ballast tanks 6 formed between the U-shaped side plating 2 and the internal plating 3, shipbuilders can more precisely and efficiently implement welding, installing, and painting operations against a hull structure in a dock than normally being executed against conventional hulls each incorporating conventional double hull structure having substantial depth and width values.

Figure 4:
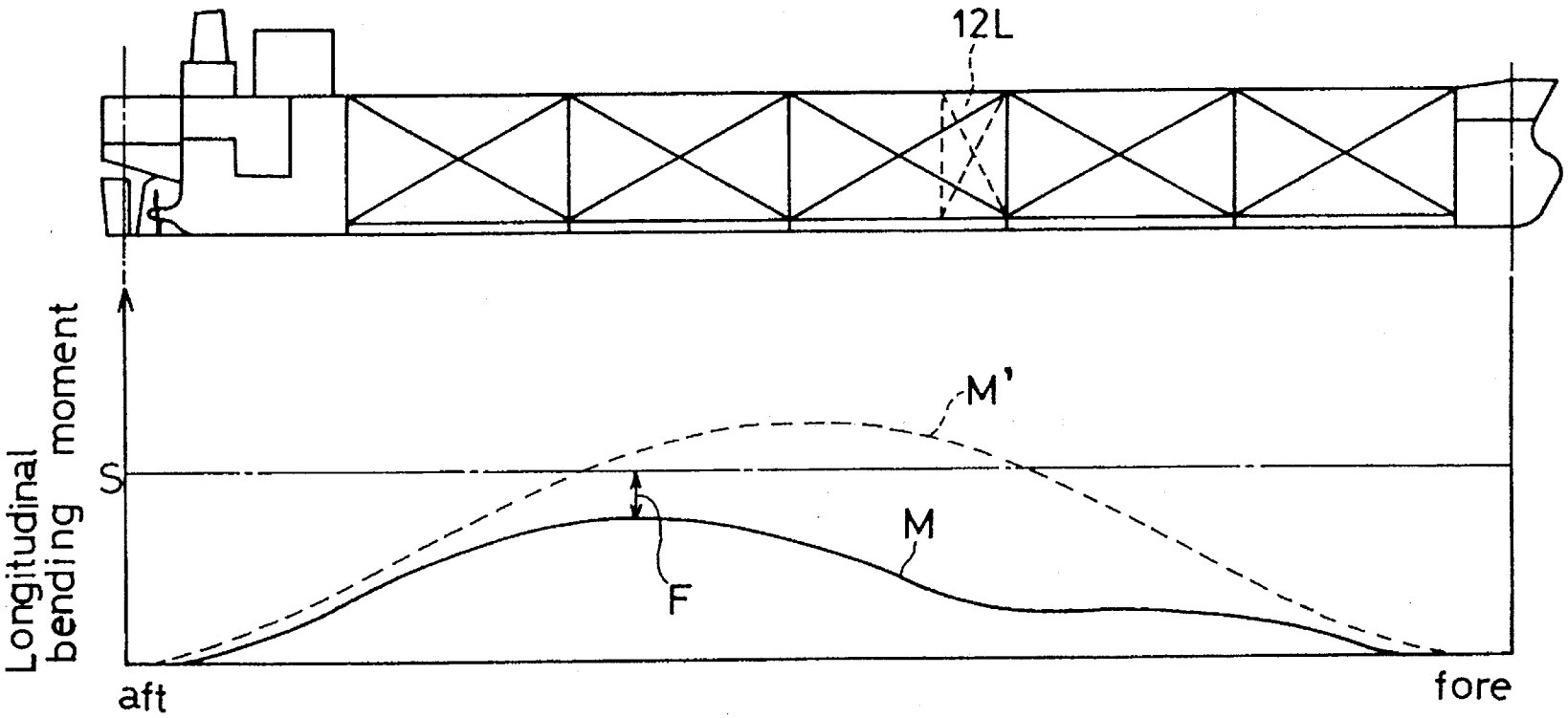
FIG. 4 is a graphic chart designating distribution of longitudinal bending moment acting upon the transport ship according to the first embodiment of the invention.

Furthermore, as a result of the provision of the tanks 12R and 12L solely being available for ballasting purpose in partial domains of the liquid cargo tanks 4R and 4L in the central domain of the hull in the fore-and-aft direction, as shown in FIG. 4, the tanks 12R and 12L respectively remain in empty condition even when the ship is fully loaded with cargo.

Therefore, unlike any of the conventional hull structures normally being subject to tremendous longitudinal bending moment M' receivable when the ship is fully loaded with cargo in the fore-and-aft direction of the hull structure, by virtue of the empty ballast tanks 12R and 12L, longitudinal bending moment M' otherwise gravely affecting the hull structure can sharply be decreased.

This in turn permits shipbuilders to dispense with overall reinforcement of the hull structure otherwise needed to deal with tremendous longitudinal bending moment M', thus making it possible for shipbuilders to prevent the hull weight from increase and provide the hull structure with enough allowance against tolerable longitudinal bending moment S. This in turn permits degree of freedom for the cargo loading containing substantial specific gravity to be promoted.

It should be understood however that overall capacity of respective liquid cargo tanks 4 remains unaffected. This is because the double-hull structure according to the invention has shallowed depth (width) of the depth values DB and DS of the above-referred space domain 5 by a certain degree corresponding to the actual capacity of those liquid cargo tanks 4 after being decreased by the ballast tanks 12R and 12L, and yet, because the internal bottom plating **3*a*** can be disposed to outer side by specific distance corresponding to the shallowed depth (width).

Next, referring now to FIGS. 5 and 6, another novel hull structure of the transport ship according to the second embodiment of the invention is described below.

Figure 5:
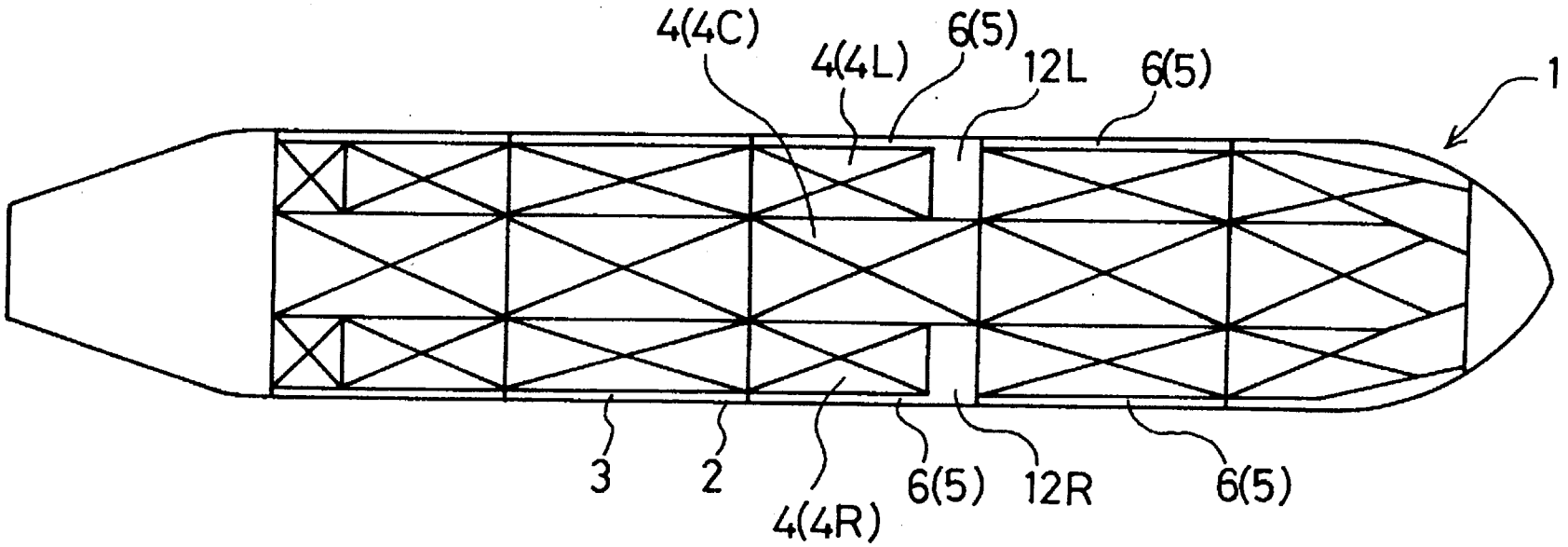
FIG. 5 is a horizontal sectional view of cargo tanks of the transport ship according to the second embodiment of the invention.
Figure 6:
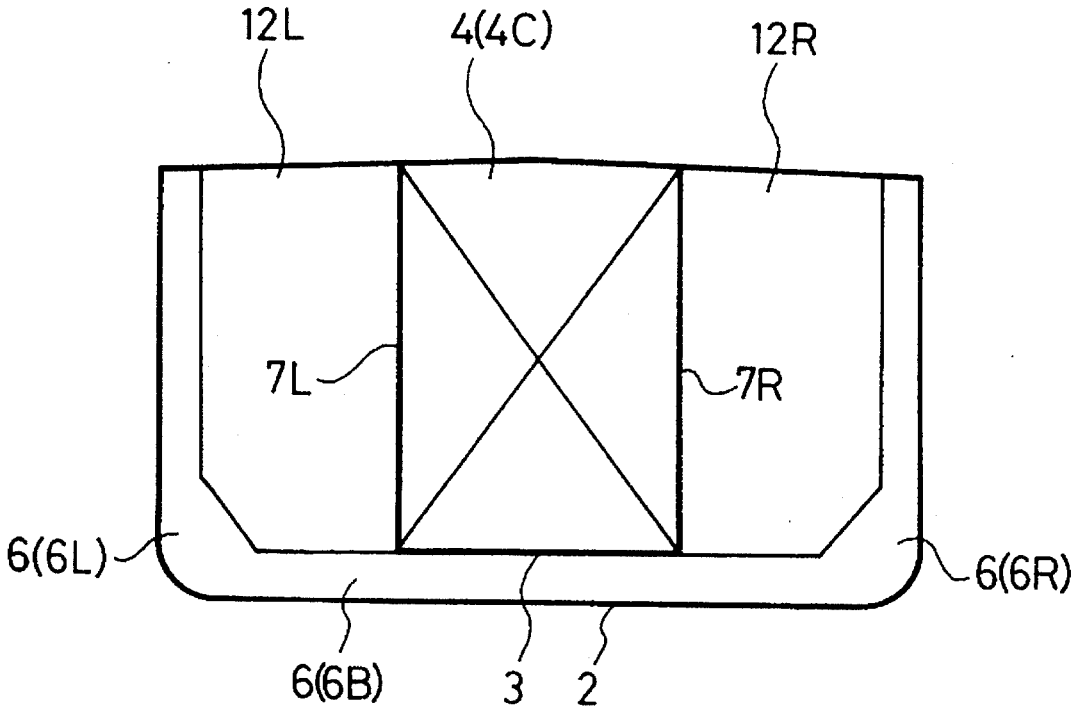
FIG. 6 is a cross-sectional view of the transport ship across line B—B shown in FIG. 5.

As shown in FIGS. 5 and 6, when building the transport ship according to the second embodiment of the invention, the internal plating 3 is excluded from interspace between the above-identified tanks 12R and 12L solely being available for ballasting purpose and the proper ballast tanks 6R and 6L in order that these ballast tanks can mutually be interconnected with each other.

By virtue of this structural arrangement, total weight of the hull structure can securely be decreased, and yet, the hull structure dispenses with ballast-water supply and discharge devices otherwise needed for the tanks 12R and 12L solely being available for ballasting purpose.

Next, referring now to FIGS. 7 and 8, another novel hull structure of the transport ship according to the third embodiment of the invention is described below.

Figure 7:
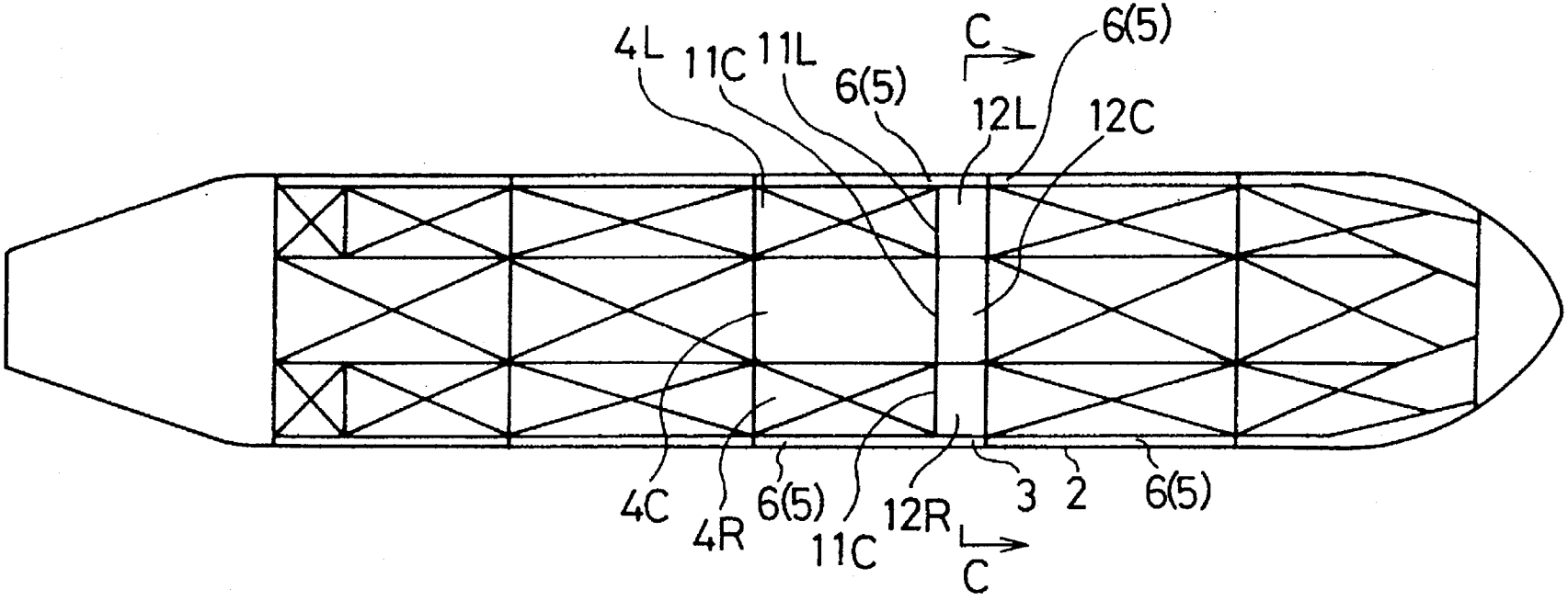
FIG. 7 is a horizontal sectional view of cargo tanks of the transport ship according to the third embodiment of the invention.
Figure 8:
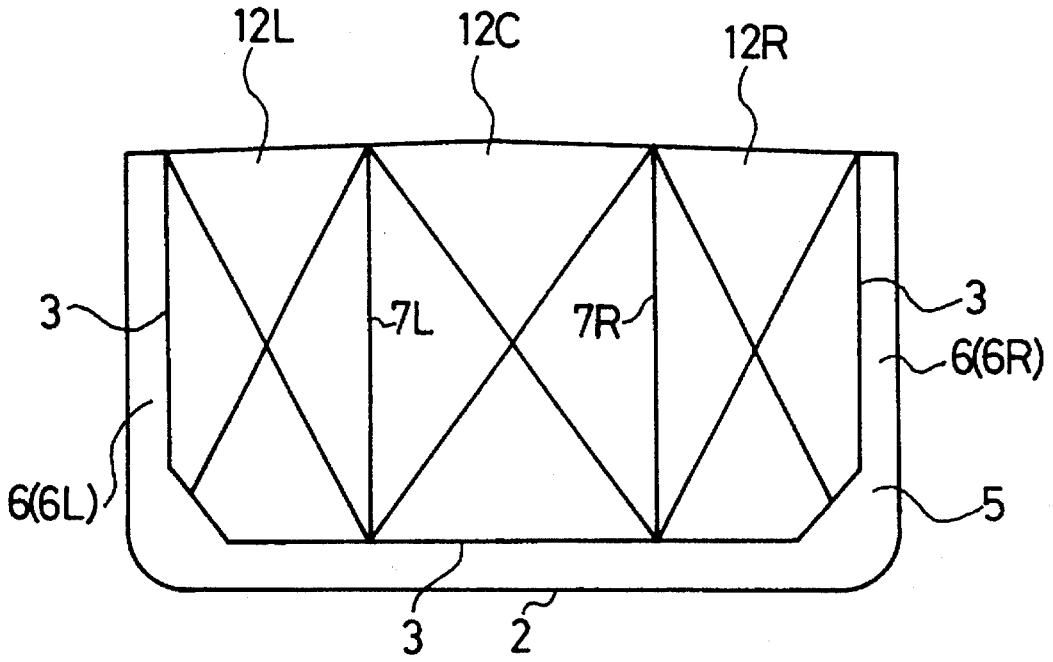
FIG. 8 is a cross sectional view of the transport ship across line C—C shown in FIG. 7.

As shown in FIGS. 7 and 8, when building the transport ship according to the third embodiment of the invention, a plurality of transverse bulkheads **11*c* are secured to the center tank 4*c* corresponding to the tanks 12R and 12L solely being available for ballasting purpose in order that another tank 12*c* solely being available for ballasting purpose can be formed. These tanks 12R, 12L, and 12*c*, are transversely provided between the port side ballast tank 6R and the starboard side ballast tank 6L**.

As another aspect of the third embodiment of the invention, it is also permissible for shipbuilders to exclude a pair of longitudinal bulkheads 7R and 7L from interspace between those tanks 12R, 12L, and **12*c* solely being available for ballasting purpose in order that these tanks 12R, 12L, and 12*c***, can integrally be interconnected with each other.

As a still further aspect of the third embodiment of the invention, it is also permissible for shipbuilders to exclude the internal plating 3 from interspace between those tanks 12R and 12L solely being available for ballasting purpose and those proper ballasting tanks 6R and 6L in order that those tanks 12R, 12L, and 12*c* solely being available for ballasting purpose can integrally be interconnected with those proper ballast tanks 6R and 6L formed in space domain 5.

The foregoing description has solely referred to the above preferred embodiments of the invention by way of providing the bottom and the side construction of the hull structure with a novel double hull structure. It should be understood however that the scope of the invention is also applicable to the hull structure furnished with a deck built with double-hull structure.

What is claimed is:

1. A liquid cargo transport ship comprising:

a double-hull structure having bottom and alongside domains surrounding a plurality of cargo tanks for loading liquid cargo, wherein said bottom and alongside domains of said transport ship respectively consist of double-hull structure comprising a side plating and an internal hull plating; wherein a space domain formed between said side plating and said internal hull plating is utilized for a plurality of proper ballast tanks; and a plurality of tanks solely being available for ballasting purpose, wherein said plurality of tanks are provided at least partly in the domain of space inside of the plurality of cargo tanks disposed in the center domain of said hull structure along the fore-and-aft direction, at least one of said plurality of tanks solely being available for ballasting purpose and at least one of said plurality of proper ballast tanks being mutually interconnected with each other to form a single ballast tank.

2. The liquid cargo transport ship having double hull structure as set forth in claim 1, wherein said tanks solely being available for ballasting purpose are formed between said proper ballast tanks on the port and starboard sides of said hull structure.

3. A double-hull structure for a liquid cargo transport ship, said double-hull structure comprising:

bottom and alongside domains, each domain comprising a side plating, and
an internal hull plating;

a plurality of cargo tanks for loading liquid cargo, said plurality of cargo tanks surrounded by the bottom and alongside domains, and disposed in a center domain of the hull structure;

a plurality of primary ballast tanks formed between the side plating and the internal hull plating;

a plurality of secondary ballast tanks provided at least partially in the interior of at least one of the plurality of cargo tanks disposed in the center domain of the hull structure, at least one of said plurality of primary ballast tanks and at least one of said plurality of secondary ballast tanks being integrally interconnected with each other to form a single unit ballast tank.

4. The double-hull structure as set forth in claim 3, wherein said secondary ballast tanks are formed between said primary ballast tanks on the port and starboard sides of said double-hull structure.

* * * * *